US006590319B2

(12) United States Patent
Moon

(10) Patent No.: US 6,590,319 B2
(45) Date of Patent: Jul. 8, 2003

(54) FLAT FLUORESCENT DISCHARGE LAMP

(75) Inventor: Jeong Min Moon, Kunpo-shi (KR)

(73) Assignee: LG. Philips LCD Co., Ltd., Seoul (KR)

( * ) Notice: Subject to any disclaimer, the term of this patent is extended or adjusted under 35 U.S.C. 154(b) by 35 days.

(21) Appl. No.: 10/020,988

(22) Filed: Dec. 19, 2001

(65) Prior Publication Data

US 2002/0167273 A1 Nov. 14, 2002

(30) Foreign Application Priority Data

May 8, 2001 (KR) ..... 2001-24861

(51) Int. Cl.[7] ..... H01J 1/88; H01J 19/42; H01K 1/18

(52) U.S. Cl. ..... 313/292; 313/238; 313/495; 313/496; 313/485; 313/243; 313/250; 313/257; 313/258; 313/274

(58) Field of Search ..... 313/495–497, 313/292, 238, 485, 243, 250, 257, 258, 274

(56) References Cited

U.S. PATENT DOCUMENTS 4,451,759 A * 5/1984 Heynisch ..... 313/495
6,046,541 A * 4/2000 Valliath et al. ..... 313/495
6,512,329 B1 * 1/2003 Mitsutake et al. ..... 313/495

* cited by examiner

*Primary Examiner*—Vip Patel
*Assistant Examiner*—Anthony Perry
(74) *Attorney, Agent, or Firm*—Morgan, Lewis & Bockius LLP

(57) ABSTRACT

A flat fluorescent discharge lamp is disclosed, which includes a first glass substrate having a plurality of electrodes to apply a voltage, a second glass substrate deposited with a first phosphor film on a surface opposite to the first glass substrate, a hollow spacer formed between the first and second glass substrates, having a window on at least one side, and a second phosphor film deposited on inner and outer sides of the spacer.

6 Claims, 7 Drawing Sheets

FLAT FLUORESCENT DISCHARGE LAMP

This application claims the benefit of Korean Patent Application No. P2001-0024861, filed in Korea on May 8, 2001, which is hereby incorporated by reference.

BACKGROUND OF THE INVENTION

1. Field of the Invention

The present invention relates to an LCD device, and more particularly, to a flat fluorescent discharge lamp for a back light of the LCD device.

2. Background of the Related Art

Demand for display devices is constantly increasing, and research on flat panel displays such as liquid crystal displays (LCD), plasma display panels (PDP), electroluminescent displays (ELD), vacuum fluorescent displays (VFD), etc., is being performed.

Among these displays, LCDs are most widely used because of their characteristics, such as good picture quality, lightweight, compactness, and low power consumption. Thus, making LCD's attractive substitutes to cathode ray tubes. Furthermore, because of their characteristics, LCD's are used in portable display devices.

The LCD device has been actively developed as a display device in various fields. However, picture quality in the LCD device can still be improved. Furthermore, the LCD device in addition to producing a high picture quality such as high luminance, fineness, and various colors still needs to maintain its characteristics of lightweight, thinness, and low power consumption.

In the LCD device, a light source for displaying the picture is required to obtain high picture quality. This is because the LCD device itself does not emit light. Accordingly, an external light source is required. The light source irradiates light of high luminance onto a display panel of the picture image uniformly, thereby generating high picture quality.

The LCD device includes an LCD display panel, a liquid crystal injected between upper and lower substrates, a light source providing light onto the LCD display panel, and a driving circuit for driving the LCD display panel.

In early LCD devices such as TN and STN, a small lamp is additionally mounted at the side or front of the liquid crystal display panel. However, the demand for large sized display panels and high picture quality, has made use of the back light assembly common. In the back light assembly, the light source is positioned at the rear of the liquid crystal display panel, and the picture image is displayed while the light passes through the liquid crystal display panel.

In the LCD device with a back light assembly, an electro luminescence (ELD), a light emitting diode (LED), a cold cathode fluorescent lamp (CCFL), or a hot cathode fluorescent lamp (HCFL), are used as light sources. Especially, the CCFL type is widely used in large sized color LCD devices since the CCFL has a long life, low power consumption, and is thin.

A phosphor discharge tube sealed with mercury gas and having argon and neon gases at a low temperature is used as the CCFL light source. Electrodes are formed at both sides of the tube, in which a cathode has a plate type. When a voltage is applied, charged particles within the discharge tube collide against the cathode, thereby generating secondary electrons. Subsequently, the secondary electrons excite circumferential elements to generate plasma. Then, the elements irradiate ultraviolet rays that excite the phosphor again, so that the phosphor emits visible rays.

The phosphor discharge tube is formed in two types, a direct type, and an edge type. First, in the direct type a plurality of phosphor discharge tubes are mounted below the liquid crystal display panel. In the edge type, the phosphor discharge tubes are mounted at both sides, below the liquid crystal display panel to view the picture image by light guiding and reflecting plates. To obtain uniform luminance of the picture image, a light-diffusion plate is formed between the liquid crystal display panel and the light source. In case of a large sized LCD device, the edge type is mainly used. However, the edge type has low luminance. Meanwhile, in the direct type, luminance decreases depending on temperature, and it is difficult to form the device thinly.

In the CCFL light source, mercury is a main element of the gas injected in the discharge tube. However, mercury reduces the life of the lamp when combined with metals, and reacts readily to temperature changes making mercury unsuitable as the main element for a light source. Also, with increased environmental concerns, waste disposal problems arise since mercury is a poisonous heavy metal. Accordingly, it is required to develop a new back light that addresses the aforementioned problems.

Therefore, a new back light that does not use mercury is being developed. For example, a flat fluorescent discharge lamp using xenon has been disclosed in U.S. Pat. No. 6,034,470, WO98/11596.

The basic principle of the flat fluorescent discharge lamp is as follows.

FIG. 1 is schematic view showing the structure of the basic flat fluorescent discharge lamp. FIG. 2 shows dots generated in the flat fluorescent discharge lamp of FIG. 1.

A plurality of electrodes 13 that apply a voltage are formed on a lower glass substrate 11. Then, an insulating film 15 is formed on the lower glass substrate including the electrodes 13. Subsequently, a passivation film 17 of oxide magnesium is deposited on the insulating film 15. A phosphor film 21 is deposited on an inner surface of an upper glass substrate 23.

The lower and upper glass substrates 11 and 23 are spaced apart from each other by a spacer 19. A discharge gas 26 is injected between the lower and upper glass substrates 11 and 23.

In the flat fluorescent discharge lamp, if the discharge voltage is applied to the electrode, the discharge gas is excited, thereby generating ultraviolet rays. The ultraviolet rays excite the phosphor film 21 deposited on the inner surface of the upper substrate 23, generating visible rays, which are irradiated as the light source of the liquid crystal display panel.

However, in the flat fluorescent discharge lamp, the spacer 19 shields a portion of the phosphor film 21. Therefore, this portion of the phosphor film is not excited by ultraviolet rays, and becomes dark. As shown in FIG. 2, when the flat fluorescent discharge lamp is turned on, a bright panel is partially dotted. The ultraviolet rays pass through the glass substrate at a low rate while the visible rays pass through the glass substrates at a high rate. For this reason, the ultraviolet rays generated from the injected gas do not pass through the spacer, and the ultraviolet rays do not excite the phosphor film of the spacer portion. Therefore, the visible rays are not generated in the portion of the spacer.

This reduces the uniform luminance of the back light and degrades display quality of the LCD device. To solve these problems, several light-diffusion devices such as light-diffusing plates need to be deposited. Or, the installed light-diffusion devices need to maintain some distances from a light-emitting unit of the flat fluorescent discharge lamp. However, the installation of such additional devices makes the whole width of the LCD device thick, increases the production cost, and reduces the reliability of the device.

To address these problems, a flat fluorescent discharge lamp has been recently disclosed.

FIG. 3 is a sectional view of a related art flat fluorescent discharge lamp. FIG. 4 is a sectional view of another related art flat fluorescent discharge lamp.

In the related art flat fluorescent discharge lamp of FIG. 3, a plurality of electrodes 13 that apply a voltage, are formed on the lower glass substrate 11. Then, an insulating film 15 is formed on the lower glass substrate including the electrodes 13. Subsequently, a passivation film 17 using oxide magnesium is deposited on the insulating film 15. A phosphor film 21 is deposited on the inner surface of the upper substrate 23.

The lower and upper glass substrates 11 and 23 are sealed to maintain constant distances by a spacer 19. A discharge gas 26 is injected between the lower and upper glass substrates 11 and 23.

In the related art flat fluorescent discharge lamp shown in FIG. 4, a plurality of electrodes 13 that apply a voltage, are formed on the lower glass substrate 11. An insulating film 15 is formed on the lower glass substrate including the electrodes 13. Then, a passivation film 17 using oxide magnesium is deposited on the insulating film 15. A phosphor film 21 is deposited on the inner surface of the upper substrate 23. Subsequently, the spacer 19 is formed on the upper substrate 23, and the phosphor film 21 is deposited on the inner surface of the upper substrate and the spacer 19. Alternatively, the spacer 19 is integrally formed on the upper substrate, and then the phosphor film 21 is deposited on the inner surface of the substrate 23 and the spacer 19.

Methods for integrally forming the spacer 19 on the glass substrate include, for example, a forming method, a grinding method, and an etching method. In the forming method, heating softens the glass substrate, and the heated glass substrate is rolled on the frame forming the spacer 19. In the grinding method, the glass substrate is mechanically grinded, thereby forming the spacer 19. Finally, in the etching method, the glass substrate is chemically etched, thereby forming the spacer 19.

Subsequently, the lower and upper glass substrates 11 and 23 are sealed, and then the discharge gas 26 is injected between the lower and upper glass substrates 11 and 23.

The flat fluorescent discharge lamp of the related art operates as follows.

As shown in FIG. 3, the phosphor film 21 is deposited on sides of the spacer 19, so that ultraviolet rays generated by the discharge gas 26 excite the phosphor film 21. Therefore, visible rays are generated, and emitted to an upper portion of the spacer through the spacer. Accordingly, the problem of a portion of the spacer 19 being partially dotted is solved to some degree.

As shown in FIG. 4, the phosphor film is not formed between the spacer 19 and the upper substrate 23. The ultraviolet rays generated by the discharge gas 26 excite the phosphor film deposited on the sides of the spacer, thereby generating visible rays. Accordingly, the visible rays are emitted to the upper portion of the spacer through the spacer, preventing the portion of the spacer from being dotted to some extent.

However, the related art flat fluorescent discharge lamp has the following problems.

First, as shown in FIG. 3, there is a constant distance between the lower and upper substrates because the spacer is deposited with phosphor film. In this case, the visible rays generated from the sides of the spacer are emitted perpendicularly to the upper glass substrate, so that the visible rays are reflected at sides of the spacer, and are absorbed into the phosphor film at sides of the spacer. For this reason, the visible rays emitted through the upper glass substrate are relatively reduced. Therefore, the luminance of this portion is different from the circumferential luminance resulting in dotting.

Furthermore, as shown in FIG. 4, the spacer is formed on the upper glass substrate, and the phosphor film is deposited on the inner surface of the upper glass substrate and on the surface of the spacer. That is, the phosphor film is not formed between the spacer and the upper glass substrate. For this reason, the ultraviolet rays generated from the surface of the spacer are emitted to the upper portion of the spacer, or are emitted to an adhesive layer between the spacer and the upper glass substrate, thereby generating dark portions. Therefore, it is necessary to adhere the spacer to the upper glass substrate, thus complicating the process steps.

Finally, as shown in FIG. 4, to form the spacer on the upper glass substrate in a single body, the glass substrate needs to be softened by heat and then rolled on the frame. Alternatively, the glass substrate can be mechanically grinded, or the glass substrate can be chemically etched. In these cases, the process steps become complicated, thereby increasing the production cost.

SUMMARY OF THE INVENTION

Accordingly, the present invention is directed to a flat fluorescent discharge lamp that substantially obviates one or more problems due to limitations and disadvantages of the related art.

An object of the present invention is to provide a flat fluorescent discharge lamp in which a spacer is hollow and has at least one open side. This allows ultraviolet rays generated by a discharge gas to reach the inner and outer surfaces of the spacer, preventing dark dots from being generated.

Additional features and advantages of the invention will be set forth in the description which follows, and in part will be apparent from the description, or may learned by practice of the invention. The objectives and other advantages of the invention will be realized and attained by the structure particularly pointed out in the written description and claims hereof as well as the appended drawings.

To achieve these objects and other advantages and in accordance with the purpose of the invention, as embodied and broadly described, a flat fluorescent discharge lamp includes a first glass substrate having a plurality of electrodes to apply a voltage, a second glass substrate deposited with a first phosphor film on a surface opposite to the first glass substrate, a spacer formed between the first and second glass substrates, having a window on at least one side, and a second phosphor film deposited on inner and outer sides of the spacer.

Additionally, the first and second glass substrates are bonded and sealed, a discharge gas is injected between the first and second glass substrates, and a voltage applied by electrodes excites the discharge gas to generate ultraviolet rays, the ultraviolet rays being transmitted to the inside of the spacer through the window of the spacer.

Also, the spacer has a void pole shape of which top and bottom surfaces and at least one side are removed to form a window that passes through ultraviolet rays.

The spacer is formed as a void pole shape of which top or bottom surfaces and at least one side are removed to form a window that passes through ultraviolet rays.

The pole shape of the spacer is any one of a cylindrical shape, a rectangular shape, a trapezoidal shape, and a conical shape.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiment(s) of the invention and together with the description serve to explain the principles of the invention.

DETAILED DESCRIPTION OF THE PREFERRED EMBODIMENTS

Reference will now be made in detail to the preferred embodiments of the present invention, examples of which are illustrated in the accompanying drawings.

Figure 1:
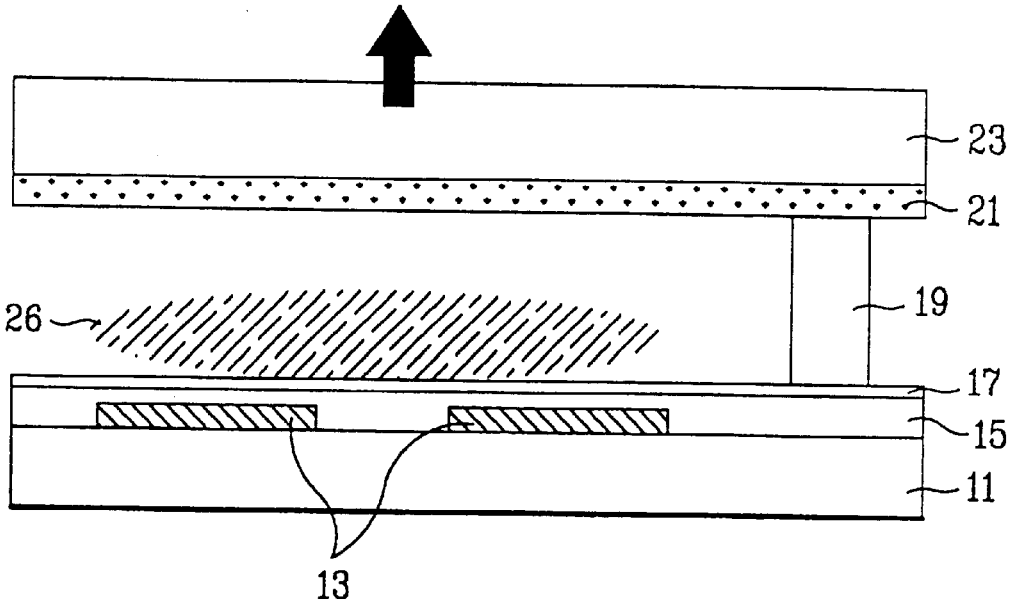
FIG. 1 Related Art
FIG. 1 is a sectional view showing a basic structure of a flat fluorescent discharge lamp.
Figure 2:
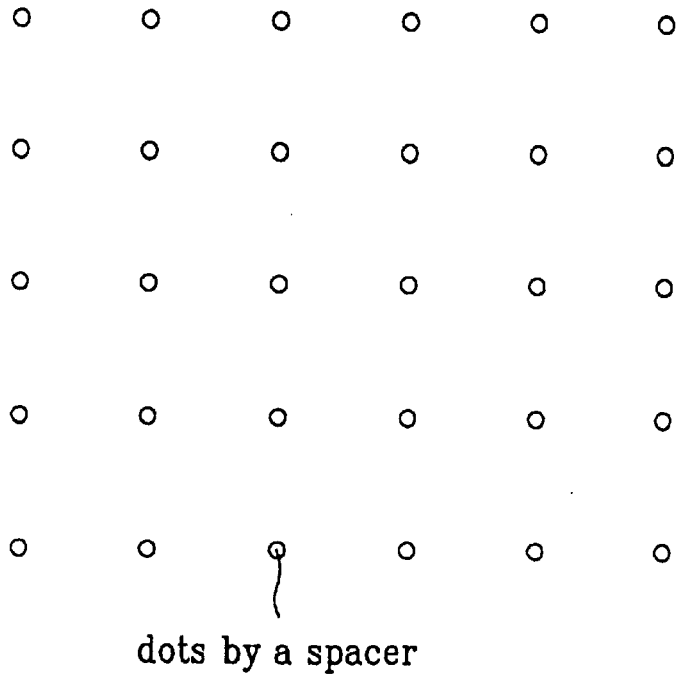
FIG. 2 Related Art
FIG. 2 shows dark portions according to the flat fluorescent discharge lamp of FIG. 1.
Figure 3:
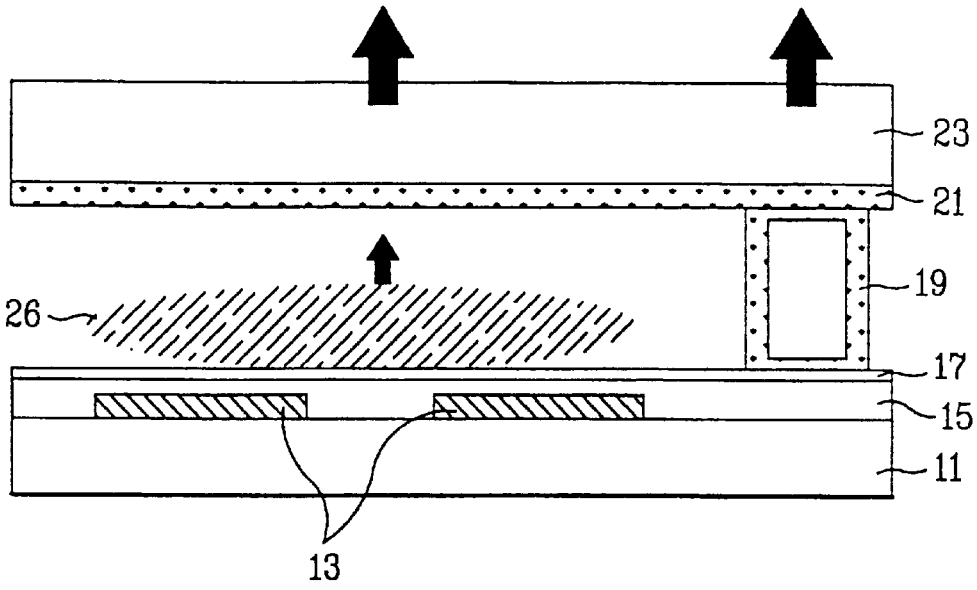
FIG. 3 Related Art
FIG. 3 is a sectional view showing a structure of the related art flat fluorescent discharge lamp.
Figure 4:
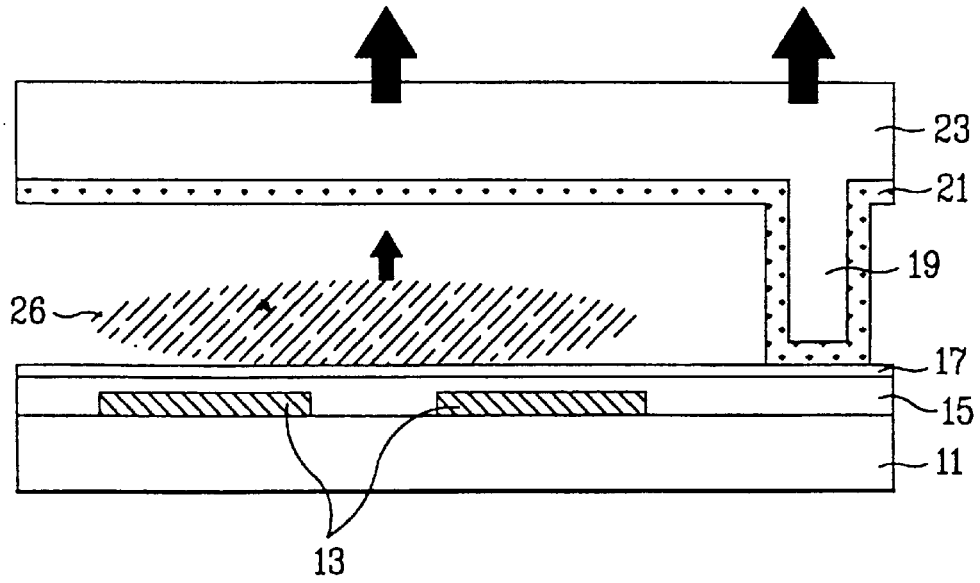
FIG. 4 Related Art
FIG. 4 is a sectional view showing a structure of another flat fluorescent discharge lamp according to the related art.
Figure 5:
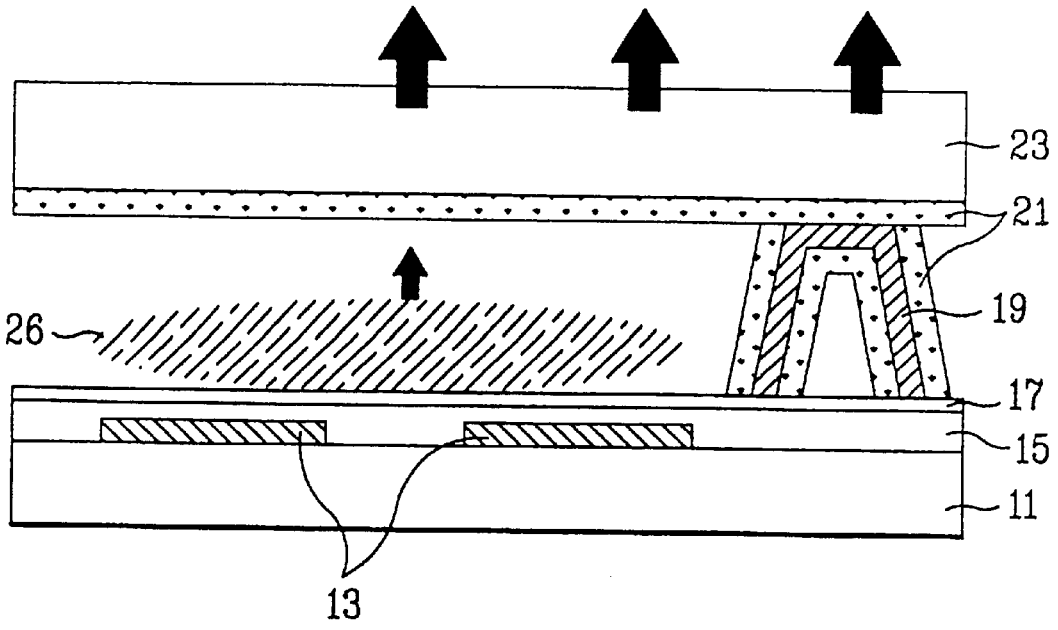
FIG. 5 is a sectional view showing a structure of the flat fluorescent discharge lamp according to one embodiment of the present invention.
Figure 9:
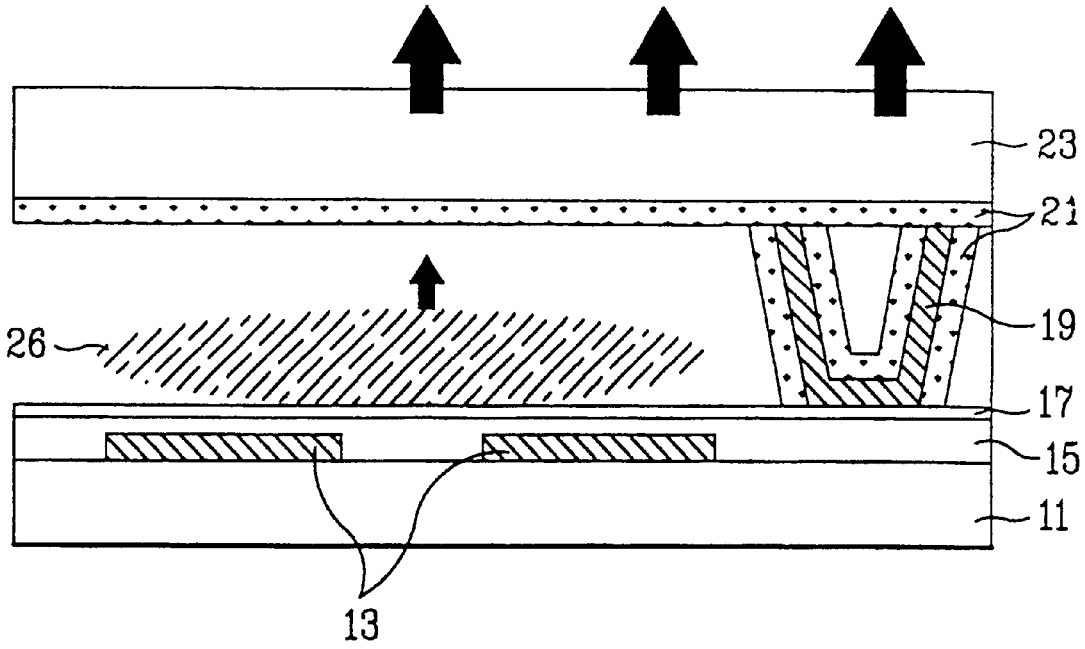
FIG. 9 is a sectional view of the flat fluorescent discharge lamp according to another embodiment of the present invention.

FIG. 5 is a sectional view showing a structure of the flat fluorescent discharge lamp according to the first embodiment of the present invention. FIG. 9 is a sectional view of the flat fluorescent discharge lamp according to another embodiment of the present invention.

As shown in FIG. 5, in the flat fluorescent discharge lamp according to the first embodiment of the present invention, a plurality of electrodes 13 that apply a voltage are formed on the lower glass substrate 11. An insulating film 15 is formed on the lower glass substrate including the electrodes 13. Then, a passivation film 17 using oxide magnesium is deposited on the insulating film 15. Thereafter, a phosphor film 21 is deposited on the inner surface of the upper substrate 23.

The spacer 19 having a void is formed between the lower and upper glass substrates 11 and 23. The spacer also has a window on at least one side to transmit ultraviolet rays, and phosphor film 21 is deposited on the inner and outer surfaces of the spacer 19.

The lower and upper glass substrates 11 and 23 are sealed to maintain constant distances by a spacer 19. A discharge gas 26 is injected between the lower and upper glass substrates 11 and 23.

The spacer can be formed in various forms, several of which will be described below.

Figure 6A:
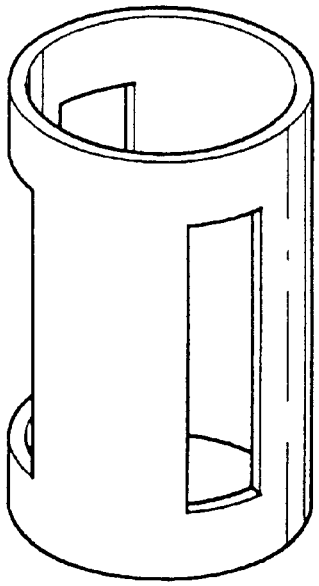
FIG. 6A and FIG. 6B are illustrative views showing spacers according to embodiments of the present invention.
Figure 6B:
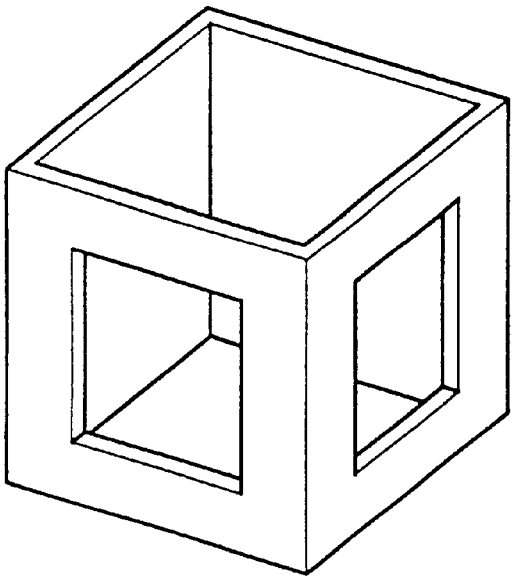

FIG. 6A and FIG. 6B are illustrative views of spacers according to embodiments of the present invention.

As shown in FIG. 6A, the spacer has a hollow cylindrical shape in which top and bottom surfaces and at least one side surface is removed to form a window that passes ultraviolet rays. At this time, phosphor films are deposited on the inner and outer sides of the spacer.

As shown in FIG. 6B, the spacer has a hollow rectangular shape in which top and bottom surfaces and at least one side surface is removed to form a window that passes ultraviolet rays. At this time, phosphor films are deposited on the inner and outer sides of the spacer.

Figure 7A:
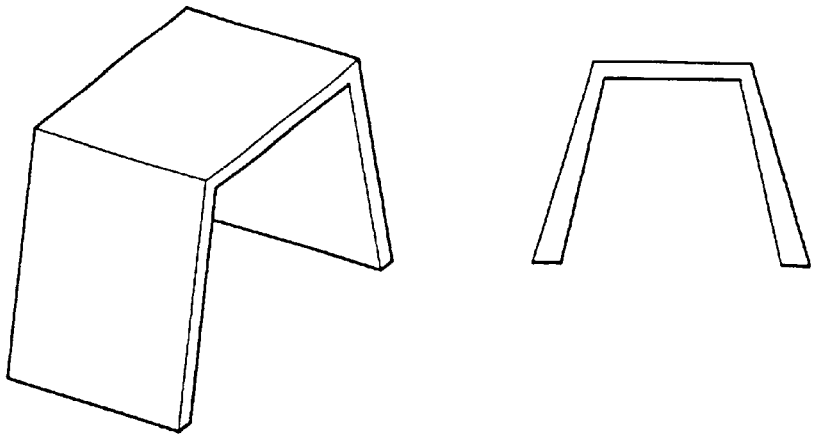
FIGS. 7A to 7C are illustrative views showing spacers according to another embodiment of the present invention.
Figure 7B:
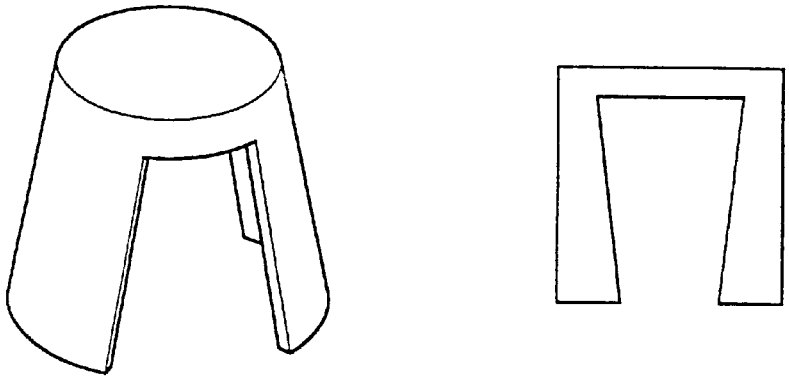
Figure 7C:
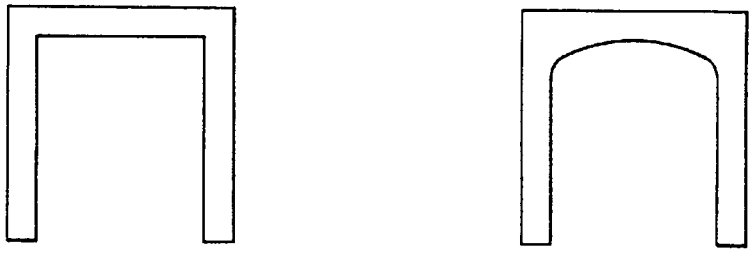

FIG. 7A to FIG. 7C are illustrative views of spacers according to other embodiments of the present invention.

FIG. 7A shows a spacer having a hollow trapezoidal shape in which a bottom surface and at least one side surface is removed.

FIG. 7B shows a spacer having a hollow conical shape in which a bottom surface and at least one side surface is removed.

FIG. 7C shows a spacer having a hollow rectangular shape in which a bottom surface and at least one side surface is removed.

Figure 8A:
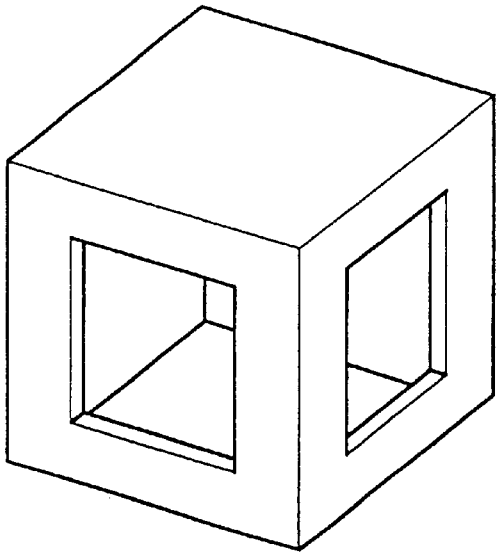
FIGS. 8A and 8B are illustrative views showing spacers according to another embodiment of the present invention.
Figure 8B:
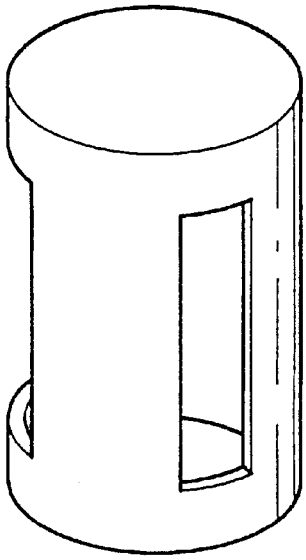

FIG. 8A and FIG. 8B are illustrative views of spacers according to different embodiments of the present invention.

FIG. 8A shows a spacer having a hollow rectangular shape in which at least one side is removed forming a window that passes ultraviolet rays. Also, phosphor films are deposited on the inner and outer sides of the spacer.

FIG. 8B shows a spacer having a hollow cylindrical shape of which at least one side is removed forming a window that passes ultraviolet rays. Phosphor films are also deposited on the inner and outer sides of the spacer.

In addition to the shapes shown in FIGS. 6 to 8, various modifications may be made to the spacers if the spacers have structures in which at least one side is removed forming a window that passes ultraviolet rays.

Also, the spacers having structures of FIG. 7A to FIG. 7C can alternatively be positioned towards the upper glass substrate, as shown in FIG. 9.

As aforementioned, the flat fluorescent discharge lamp according to the embodiments of the present invention has the following advantages.

First, in the present invention, the spacer has a hollow shape in which at least one side is removed forming a window that passes ultraviolet rays. Also, phosphor is deposited on the inner and outer sides of the spacer. Therefore, the ultraviolet rays excite the phosphor deposited on the inner side of the spacer, so that visible rays generated from the spacer are emitted towards the upper glass substrate. In this case, there is almost no difference of the luminance between the portion of the spacer and the circumferential portions. Accordingly, it is possible to prevent dark dots from being generated in the portion of the spacer.

Also, it is not necessary to adhere the spacer to the upper glass substrate, or to integrally form the spacer with the upper glass substrate. Therefore, the manufacturing process is simplified, and the overall yield is improved.

It will be apparent to those skilled in the art that various modifications and variations can be made in the flat fluorescent discharge lamp of the present invention without departing from the spirit of scope of the invention. Thus, it is intended that the present invention cover the modifications and variations of this invention provided they come within the scope of the appended claims and their equivalents.

What is claimed is:

1. A flat fluorescent discharge lamp comprising:

a first glass substrate having a plurality of electrodes to apply a voltage;

a second glass substrate deposited with a first phosphor film on a surface opposite to the first glass substrate;

a hollow spacer formed between the first and second glass substrates, having a window on at least one side; and a second phosphor film deposited on inner and outer sides of the spacer.

2. The flat fluorescent discharge lamp as claimed in claim 1, wherein the first and second glass substrates are bonded and sealed, a discharge gas is injected between the first and second glass substrates, and a voltage applied by electrodes excite the discharge gas to generate ultraviolet rays, the ultraviolet rays being transmitted to the inner sides of the spacer through the window of the spacer.

3. The flat fluorescent discharge lamp as claimed in claim 1, wherein the spacer has a hollow pole shape in which top and bottom surfaces are removed to pass ultraviolet rays.

4. The flat fluorescent discharge lamp as claimed in claim 3, wherein the pole shape spacer is of any one of a cylindrical shape, a rectangular shape, a trapezoidal shape, and a conical shape.

5. The flat fluorescent discharge lamp as claimed in claim 1, wherein the spacer is formed as a hollow pole shape of which top or bottom surfaces are removed to pass ultraviolet rays.

6. The flat fluorescent discharge lamp as claimed in claim 5, wherein the pole shape spacer is any one of a cylindrical shape, a rectangular shape, a trapezoidal shape, and a conical shape.

* * * * *